United States Patent [19]

Spina

[11] Patent Number: 5,052,603

[45] Date of Patent: Oct. 1, 1991

[54] IMPLEMENT HOLDER

[75] Inventor: Philip F. Spina, Brooklyn, N.Y.

[73] Assignee: Cousins Haulkholder Incorporated, New York, N.Y.

[21] Appl. No.: 510,541

[22] Filed: Apr. 18, 1990

[51] Int. Cl.[5] ..... A45F 5/00

[52] U.S. Cl. ..... 224/270; 224/253; 224/904

[58] Field of Search ..... 224/191, 195, 200, 226, 224/232, 234, 251, 253, 248, 269, 270, 904, 968, 241, 914; 206/60.1, 70.6; 248/220.4, 220.3, 222.1; 211/70.6, 94.5

[56] References Cited

U.S. PATENT DOCUMENTS

| | | | |
|---|---|---|---|
| 1,043,675 | 11/1912 | Crocket | 222/270 |
| 3,599,847 | 8/1971 | Danielson | 224/25 R |
| 3,897,926 | 9/1975 | Silver | 248/221.2 |
| 4,300,708 | 11/1981 | Pattermann | 224/253 |
| 4,372,468 | 2/1983 | Harvey | 224/904 |
| 4,723,663 | 2/1988 | Learn | 211/70.06 |
| 4,790,461 | 12/1988 | Stover | 224/234 |
| 4,809,894 | 3/1989 | Viio | 224/248 |
| 4,936,499 | 6/1990 | Gulley | 224/904 |

*Primary Examiner*—Ernest G. Cusick
*Assistant Examiner*—David J. Walczak
*Attorney, Agent, or Firm*—Auslander & Thomas

[57] ABSTRACT

A holder for an implement such as a mortar board which is to be horizontally positioned, comprises a back plate having slots which receive a worker's belt so that the holder can hang on the belt and an L-shaped frame which has a vertical portion selectively attachable to the back plate and a horizontal portion which has two elongated supporting arms which protrude outwardly away from the back plate and are disposed in spaced relationship. The handle of the mortar board is inserted into the space between the arms so that the flat board rests on the two supporting arms. When the handle is engaged between the two supporting arms and the board rests on the supporting arms, both hands of the worker are free to conduct other operations.

31 Claims, 3 Drawing Sheets

FIG.1
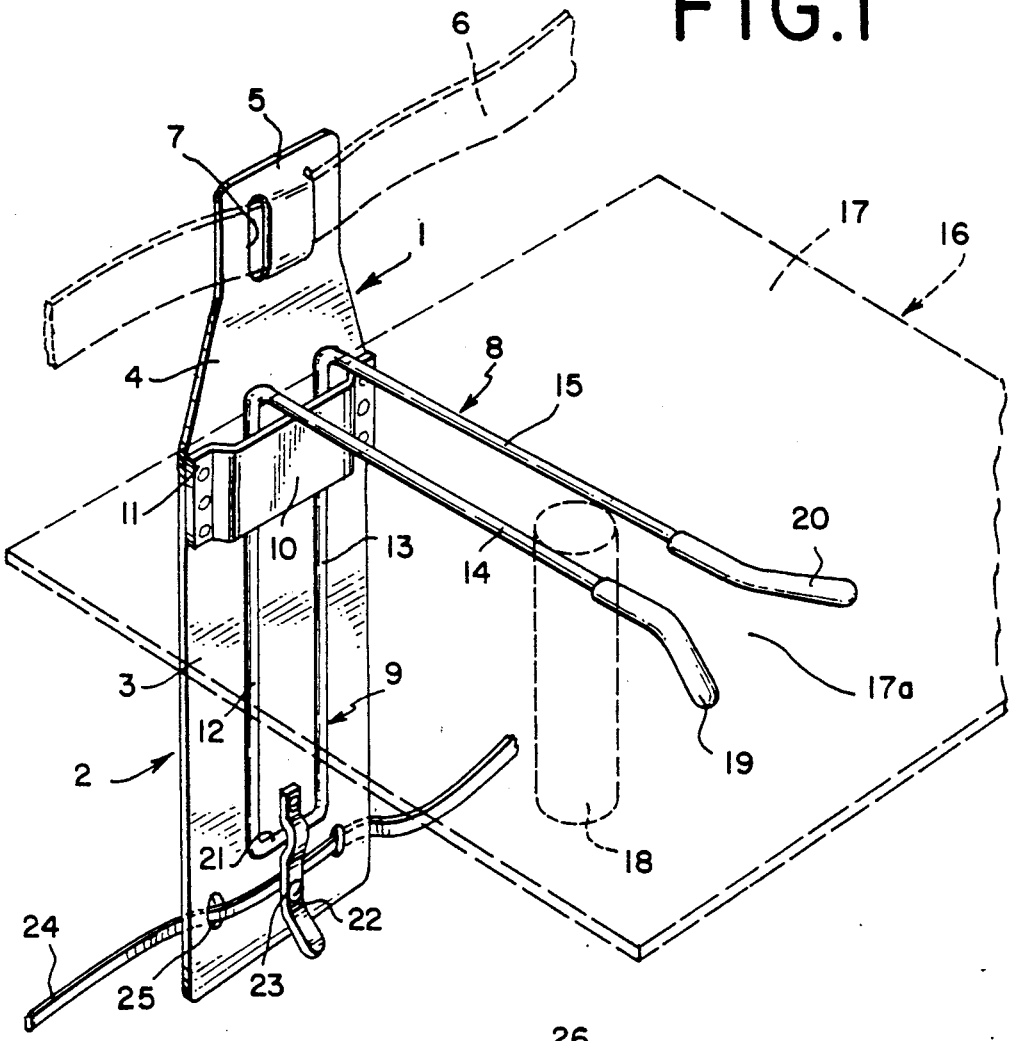
FIG.2
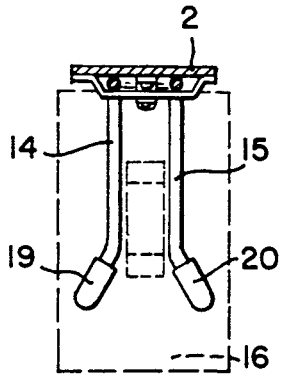
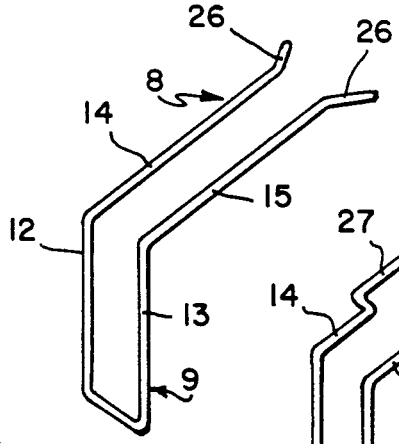
FIG.3
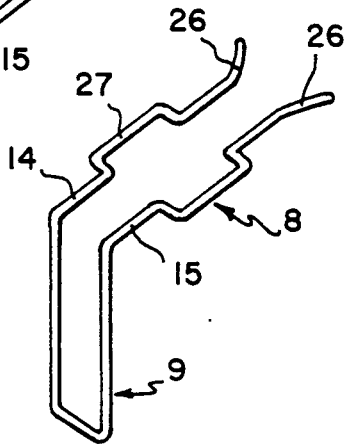
FIG.4

FIG.12
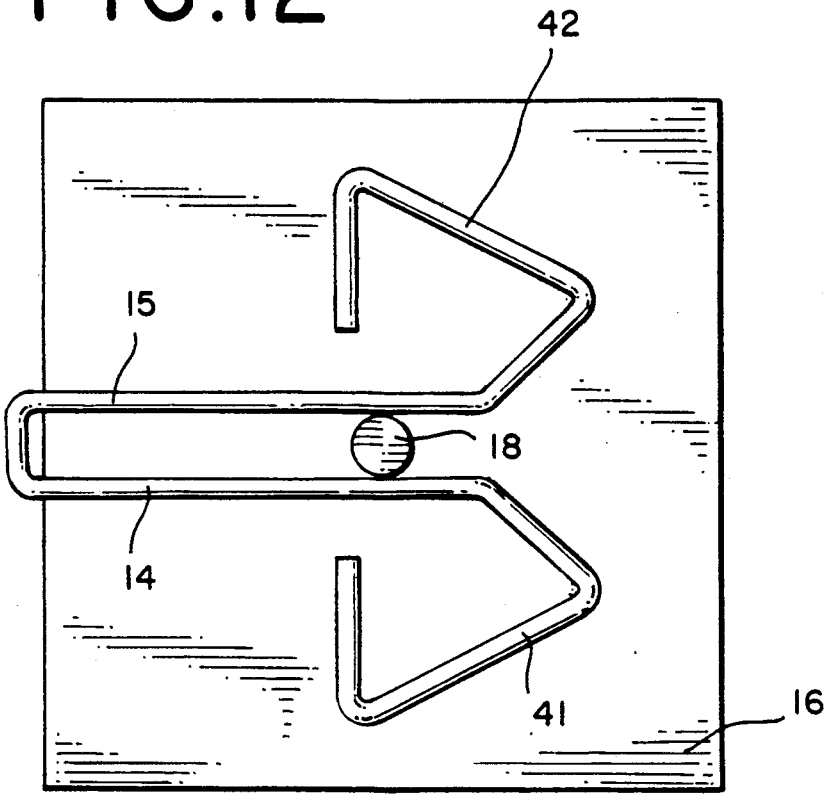
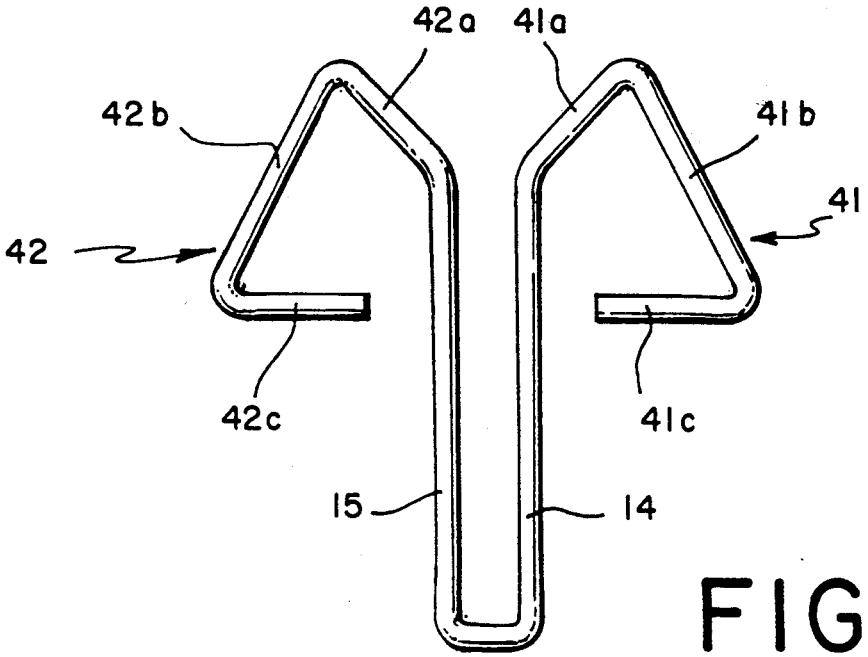
FIG.11

IMPLEMENT HOLDER

BACKGROUND OF THE INVENTION

The present invention generally relates to a belt suspended implement holder, and more particularly, to a holder for supporting a board, such as a mortar board, which is attachable to the user's belt and/or leg to thereby free both the user's hands for different operations.

BRIEF DESCRIPTION OF THE PRIOR ART

U.S. Pat. No. 3,599,847, discloses a belt suspended hammer holder that includes an L-shaped bracket supported by the belt or string of a carpenter's apron. The vertical portion of the L-shaped bracket has circular holes for receipt of the belt or string. The horizontal portion of the bracket is bifurcated to form two horizontally disposed legs which define a U-shaped opening for loose receipt of the head shank of a hammer. The hammer may be removed from the opening by lifting and lateral motions.

U.S. Pat. No. 4,790,461 teaches an implement holder for a claw hammer, which includes a support pad having slots for receipt of a waist band and a cradle like collar projecting from the support pad which defines a tool storage opening for receiving the hammer. The hammer is inserted into the cradle like collar and suspended on a wire loop of the collar.

U.S Pat. No. 1,043,675 discloses a leg bracket which is secured to the carpenter's leg above the knee to support one end of a board while cutting the board. The bracket includes a plate curved to conform to the contour of the leg and a board supporting arm which is pivotally mounted to the plate. The supporting arm may be selectively fastened in a position normal to the plate or parallel to the plate. Two straps for securing the plate to the user's leg pass through eyes mounted in the plate.

U.S. Pat. No. 4,809,894 shows a holder for detachably securing objects to an article of clothing, such as trousers. The holder includes a carrier part for receipt of an object, such as a hammer, screwdriver, or an electric drill, and two arms integrally formed with the carrier part and extending in mutually opposite lateral directions, the arms having bent ends which can be inserted into respective loops on an article of clothing, such as belt loops provided on trousers.

U.S. Pat. No. 4,300,708 discloses a carrier for a drywall taper's knife, which can be suspended from the worker's body. Slits receiving the worker's body belt are provided therefor in an upright pocket of the carrier.

None of the prior art implement support devices provide stable means to support a board or other flat, wide surface suitable for holding a body of plaster or like consisting material in a convenient position to the worker as herein provided.

SUMMARY OF THE INVENTION

It is an object of the present invention to provide an implement holder capable of supporting a board or box like structure in horizontal suspension from the worker's body.

It is another object of the present invention to provide an implement holder that provides stable support of a mortar board so that both hands of the worker can be left free for use in other operations as needed.

In brief, the implement holder according to the present invention comprises a back plate having holes which receive a worker's belt so that the plate can be suspended from the belt and a supporting frame attached to the back plate for supporting a flat implement, such as a mortar board, in horizontal disposition from the worker's body. The supporting frame includes a vertical portion which is inserted into a yoke or bracket attached to the back plate to secure the frame to the back plate, and a horizontal portion comprising two parallel elongated supporting arms disposed in spaced relationship and forming an open mouth for receipt of a handle, or the like, of the mortar board. Engagement of the handle between the elongated arms of the horizontal portion provides stable support for the board, thus freeing both hands of the worker. The supporting frame can be easily pulled from the yoke or bracket of the back plate as desired.

BRIEF DESCRIPTION OF THE DRAWINGS

Although such novel feature or features believed to be characteristic of the invention are pointed out in the claims, the invention and the manner in which it may be carried out may be further understood by reference to the description following and the accompanying drawings.

FIG. 1 is a perspective view of a first embodiment of the implement holder according to the present invention, shown having a mortar board supported thereon;

FIG. 2 is a top plan view of the implement holder, on a reduced scale;

FIG. 3 is a perspective view of the supporting frame of the holder shown in FIGS. 1 and 2;

FIG. 4 is a perspective view of a second embodiment of a supporting frame;

FIG. 11 is a top plan view of a supporting frame having laterally extending wings.

FIG. 12 is a bottom plan view of the supporting frame of FIG. 11, shown engaging a mortar board.

DETAILED DESCRIPTION OF THE PREFERRED EMBODIMENTS

Figure 6:
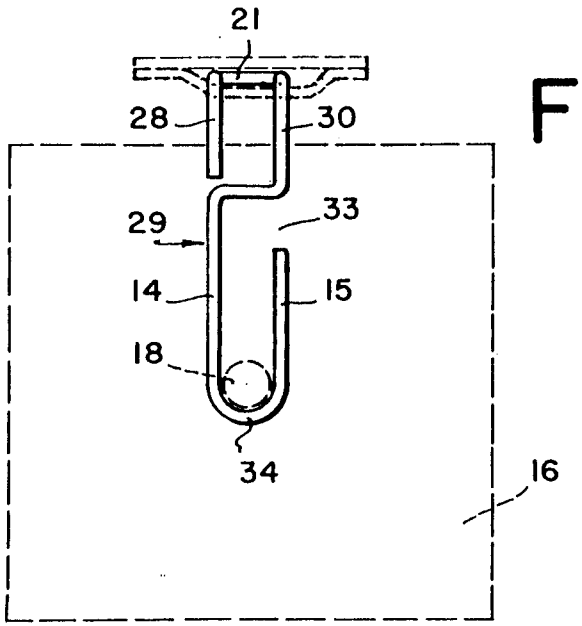
FIG. 6 is a top plan view of a further embodiment of the implement holder of the present invention, shown supporting a mortar board.

Referring now to the figures in greater detail, where like reference numbers denote like parts in the various figures.

It can be seen that an implement holder constructed in accordance with the teachings of the present the invention and designated in general by reference numeral 1 in FIG. 1, includes a substantially flat, vertically disposed back plate 2 and a substantially L-shaped supporting frame 8, selectively attachable to the back plate 2. Back plate 2 is preferably a rigid structure made, for example, of plastic and includes an elongated main portion 3, a narrowing transition portion 4 and belt connecting portion 5 for attachment of the back plate 2 to a belt 6 of the user. Belt connecting portion 5 has paired, vertical slots 7 threadedly receiving the belt 6, thereby permitting the back plate 2 to hang from the belt 6 when the holder 1 is in use. The supporting frame 8 is preferably made of metal and includes a vertical U-shaped lower portion 9, two vertical arms 12, 13 of the lower portion 9 of the frame 8 merging into two horizontally disposed and parallel upper arms 14, 15 which define a support for any suitable horizontal structure of an implement for which the holder 1 is intended. A mortar board 16, shown as an exemplary suitable horizontal structure, includes a flat plate like support 17 onto which mortar or plaster is placed and a cylindrical rod like handle 18, downwardly projecting from the support 17. The mortar board bears the upper arms 14 and 15 of the supporting frame 8 having the rod like handle 18 disposed within the open mouth 17*a* formed by the upper arms 14 and 15. Upper arms 14 and 15 terminate in outwardly flanging bent portions, 26 (FIG. 3) which are enclosed by respective rubber or leather safety cups 19 and 20.

The vertical lower portion 9 of supporting frame 8 engages a fastening yoke 10 that is fixedly attached to the front wall 3 of back plate 2 by means of a plurality of rivets or bolts 11.

To provide stable positioning of the supporting frame 8 within vertical yoke 10, the transverse web 21 of the vertical portion 9 of frame 8, is further secured in yoke 10 by means of a strap 22, the upper end of said strap 22 being fully attached to the main portion 3 and the lower end of said strap 22 being provided with a snap fastener 23 for selective fastening of the vertical lower portion 9 of the supporting frame 8.

Spaced apart holes 25 are formed near the lower end of the main portion 3 is of back plate 2 for receipt of a strap 24. The strap 24 may be a rubber hose, bungee, leather rawhide tape or string. The strap 24 may be tied around the worker's leg to stabilize the back plate 2, with the vertical portion 9 of the frame 8 when the vertical portion 9 of the frame 8 is engaged in the transversed yoke 10 and held down on the back plate 2 by the strap 22.

The back plate 2 engaged with a belt 6, threaded through the vertical slots 7, in conjunction with the strap 24, stably support the engaged frame 8. Thus, when a board 16 with a handle 18 is engaged on top of the arms 14 and 15, the implement holder 1 is stably supported.

As user's belt 6 holds the back plate 3, suspended therefrom, with the frame 8 attached to the back plate 3 and supporting the mortar board 16, the handle 18 of the mortar board 16 being engaged between the two upper arms 14 and 15, the entire assembly is in a stable position, particularly with the aid of strap 24, and the worker has both hands free. Particularly, when setting up plaster board walls, the worker must tape the walls between the plaster boards, then plaster over the tape to finish the wall and great difficulties occur in properly manipulating the tape, the mortar board and the trowel. Therefore, freeing both hands of the worker by use of the implement holder 1 of the present invention substantially facilitates the plastering process as well as many other processes.

FIGS. 3 through 12 illustrate various embodiments of the supporting frame 8 which is preferably of a one piece construction made of a cylindrical rod bent to form a U-shaped configuration which is further bent into the L-shaped configuration to provide two vertical arms 12, 13 of the lower portion 9 and two horizontal upper arms 14, 15 which constitute the support for the mortar board 16.

FIGS. 2 and 3 illustrate the embodiment of frame 8 of the holder described in connection with FIG. 1.

Figure 10:
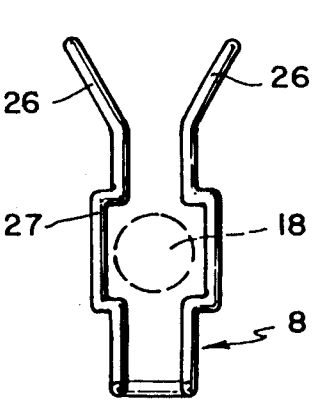
FIG. 10 is a top plan view of the frame of the holder of FIG. 4.

In the embodiment illustrated in FIG. 4, an enlarged portion 27, formed by right angled bends in the upper arms 14, 15, is provided to receive a downwardly projecting handle 18 of a larger diameter, as shown in FIG. 10. Outwardly flanging portions, 26 facilitate the insertion of handle 18 into the space between two parallel arms 14 and 15.

The enlarged portion 27 serves several important functions. It enables a wide diameter handle 18 to be grasped within the enlarged portion 27, held in the right angulated bends, so that it cannot easily slide out. Any handle engaged between the parallel horizontal arms 14, 15 are held more securely within the enlarged portion 27, since they do not have a straight path to slide out. Although it is easier and preferable to be able to engage the handle 18 by sliding it backwards over the top of the horizontal upper arms 14, 15, the enlarged portion 27 is an enablement to engage the mortar board 16 and handle 18 by insertion from the bottom of the handle into the enlarged portion 27 as an alternate means of using the folder 1 to stably support the mortar board 16.

Figure 5:
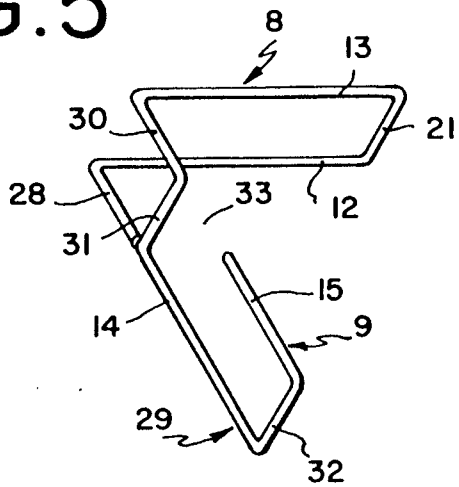
FIG. 5 is a perspective view of a third embodiment of a supporting frame.

FIG. 5 shows a further version of the L-shaped support frame 8. The lower portion of frame 8 is formed as heretofore described. Supporting portion 29 is formed by paired horizontally disposed and parallel frame members 28, 30, which merge with the vertical arms 12, 13 of the lower portion 9 at one end and are connected by a first transverse bar 31 at the opposite ends thereof, and two parallel arms 14 and 15 connected to each other by a second transverse bar 32 substantially parallel to said first transverse bar 31, one arm, for example, 14, being attached at the juncture of the first transverse bar 31 and frame member 28. Arm 15 is substantially shorter than the arm 14, so that an opening 33 is provided to receive the handle 18 of a mortar board 16. The handle 18 is slid through opening 33 into the space between two supporting arms 14 and 15, and mortar board 16 rests on the surface of frame members 28 and 30, transverse bars 31 and 32 and arms 14 and 15.

Figure 7:
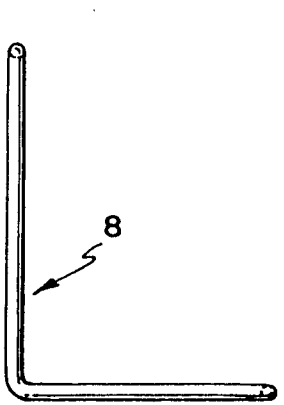
FIG. 7 is an inverted side plan view of the supporting frame of FIG. 5.

The embodiment illustrated in FIG. 6 differs from the embodiment shown in FIGS. 5 and 7 in that parallel supporting arms 14 and 15 are interconnected by a semicircular portion 34 instead of straight second transverse bar 32. The inner diameter of semicircular portion 34 corresponds to the outer diameter of the cylindrical handle 18 so that the handle of the mortar board 16 is slid through the opening 33 into the space between arms 14 and 15 until the circular portion 34 engages handle 18 in a snug fit.

Figure 8:
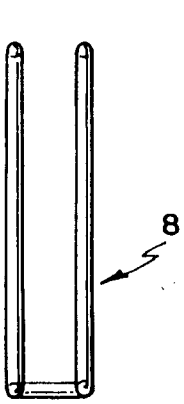
FIG. 8 is a top plan view of a further embodiment of a supporting frame.

In the embodiment of FIG. 8, outwardly flanging bent portions, 26 as described for the first embodiment of supporting frame 8 are omitted, and arms 14 and 15 extend for the same length.

Figure 9:
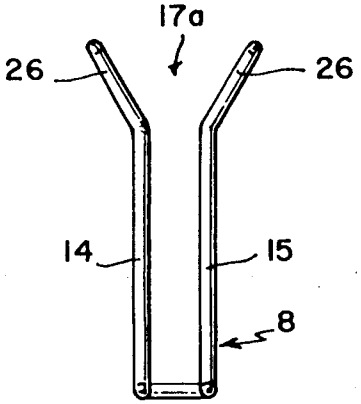
FIG. 9 is yet another embodiment of the supporting frame, shown in a top plan view.

In the embodiment of FIG. 9, the two parallel arms 14 and 15 have longer outwardly bent portions 25, 26, than as previously described, at the distal end of the arms 14, 15 so as to form a V-shaped mouth 17*a* which facilitates engagement of handle 18 within the supporting frame 8.

FIGS. 11 and 12 illustrate an embodiment of supporting frame 8 which includes transversely extending wings 41, 42, outwardly disposed to each side and integrally formed with the upper arms 14, 15 of frame 8. Said wings 41, 42 provide a wider platform for support of a mortar board 16 or the like, for greater board 16 stability. The wings 41, 42 are shown in FIGS. 11 and 12 having three wing segments 41*a*, 41*b*, 41*c* and 421, 42*b*, 42*c*, integrally formed and bent at acute angles in consistent rotational progressions for illustration purpose only and said wings 41, 42 may be configured in a variety of shapes without departing from the scope and spirit of this disclosure. In FIG. 12 it can be seen that handle 18 of mortar board 16 is disposed between upper arms 14, 15 as has been heretofore described and is now understood.

Supporting frame 8 is removably attachable to back plate 3 so that the user does not have to carry the entire assembly when involved in another operation. By detaching strap 22, as shown in FIG. 1, the entire frame 8 can be pulled out from yoke 10 of back plate 3, allowing the back plate 3 to remain attached to the user's belt 6.

The terms and expressions which are employed are used as terms of description; it is recognized, though, that various modifications are possible.

It is also understood that the following claims are intended to cover all of the generic and specific features of the invention herein described, and all statements of the scope of the invention which, as a matter of language, might fall therebetween.

Having described certain forms of the invention in some detail, what is claimed is:

1. An implement holder for supporting in a substantially horizontally position an implement having a substantially large flat underside and a vertically disposed handle, comprising a back plate provided with means to attach the holder to a user's belt; and a supporting frame attachable to said back plate, said supporting frame including a substantially vertical portion selectively attachable to said back plate, said vertical portion including two vertical arms interconnected at one vertical end thereof with a transverse web and merging at the other end thereof into two elongated arms of a substantially horizontal portion, said transverse web secured to said back plate by a strap, said horizontal portion forming an implement support including said elongated arms disposed in spaced relationship defining an unobstructed open mouth for the receipt of the handle of said implement, said mouth formed at distal ends of said elongated arms, said arms adapted to support thereon in bearing engagement said large flat underside of said implement, and said back plate including means for stably engaging said back plate to user's leg.

2. The implement holder according to claim 1, wherein said frame is of L-shaped configuration.

3. The implement holder according to claim 2, wherein said vertical portion is of U-shaped configuration.

4. The implement holder according to claim 1, wherein said mouth is formed at distal ends of said elongated arms.

5. The implement holder according to claim 1, further comprising yoke means for securing said vertical portion to said back plate.

6. The implement holder according to claim 5, wherein said yoke means includes a yoke selectively fastened to said back plate and formed to hold said lower portion against a front wall of said back plate.

7. The implement holder according to claim 1, wherein said back plate has an upper portion formed with holes for receipt of a user's belt.

8. The implement holder according to claim 1, wherein at least one end of said said elongated arms includes a safety cup.

9. The implement holder according to claim 8, wherein said said at least one cup are made of rubber.

10. The implement holder according to claim 1, wherein said elongated arms have at distal ends thereof outwardly bent portions to facilitate insertion of said handle into said space between said elongated arms.

11. The implement holder according to claim 10, wherein said elongated arms have between said lower portion and distal ends thereof an enlarged portion formed by right angled bends in the upper arms which form therebetween a space to receive the handle of an implement of a larger diameter.

12. The implement holder according to claim 11 wherein said elongated arms are bent to form a V-shaped mouth.

13. The implement holder according to claim 11, wherein said implement is a mortar board.

14. The implement holder according to claim 13, wherein the handle of said mortar board is substantially cylindrical and extends downwardly from the flat underside of the mortar board.

15. The implement holder according to claim 1, wherein said elongated arms of said supporting portion include integrally formed wings which laterally extend to opposing sides of the respective arms.

16. The implement holder according to claim 15, wherein said wings are formed by segments disposed at acute angles in consistent rotational progressions.

17. The implement holder according to claim 1, wherein said supporting frame is removably attachable to said back plate.

18. The implement holder according to claim 1, wherein said elongated arms are parallel.

19. An implement holder for supporting in a substantially horizontally position an implement having a substantially large flat underside and a vertically disposed handle, comprising a back plate provided with means to attach the holder to a user's belt; and a supporting frame attachable to said back plate, said supporting frame including a substantially vertical portion selectively attachable to said back plate and a substantially horizontal implement supporting portion, said horizontal implement supporting portion including an elongated arm disposed in a spaced relationship defining an open mouth for the receipt of the handle of said implement, said vertical portion including two vertical arms interconnected at one vertical end thereof by a transverse web, said vertical arms merging at the other end thereof into the elongated arm of said substantially horizontal portion, said elongated arm including a transverse bar at its distal end, and a second transverse bar near its other end, said elongated arm formed of a portion spaced away from said open mouth, said horizontal implement supporting portion arm supporting thereon in bearing engagement said large flat underside of said implement, and said back plate including means to be stably engaged at a user's leg.

20. The implement holder according to claim 19 including a second transverse bar substantially perpendicular to said other transverse bar.

21. The implement holder according to claim 20, wherein said first and second transverse bars are substantially parallel to each other.

22. The implement holder according to claim 19, wherein said first transverse bar is a portion of semicircular configuration and merges into said elongated arm.

23. The implement holder according to claim 22 wherein an inner diameter of said portion of semi-circular configuration corresponds to the outer diameter of the handle of an engaged implement.

24. The implement holder according to claim 19 wherein said vertical portion is of U-shaped configuration.

25. The implement holder according to claim 19, further comprising yoke means for securing said vertical portion to said back plate.

26. The implement holder according to claim 25, wherein said yoke means includes a yoke selectively fastened to said back plate and formed to hold said lower portion against a front wall of said back plate.

27. The implement holder according to claim 26, further comprising means for connecting said transverse web to said back plate.

28. The implement holder according to claim 27 wherein said connecting means includes a strap secured at one thereof to said back plate and enclosing said transverse web when said lower portion is held by said yoke.

29. The implement holder according to claim 19, wherein said back plate has an upper portion formed with holes for receipt of a user's belt.

30. The implement holder according to claim 19, wherein said implement is a mortar board.

31. The implement holder according to claim 30, wherein the handle of said mortar board is substantially cylindrical and extends vertically downwardly from the large flat underside of the mortar board.

* * * * *